United States Patent [19]

Joy et al.

[11] Patent Number: 4,722,743

[45] Date of Patent: Feb. 2, 1988

[54] COLLECTING ELECTRODE PANEL ASSEMBLY

[75] Inventors: Ira L. Joy, Alabaster; Keith P. Shedd, Birmingham, both of Ala.

[73] Assignee: Combustion Engineering, Inc., Windsor, Conn.

[21] Appl. No.: 887,462

[22] Filed: Jul. 21, 1986

[51] Int. Cl.[4] ..... B03C 3/86

[52] U.S. Cl. ..... 55/148; 55/145; 55/156

[58] Field of Search ..... 55/143, 145, 148, 149, 55/140, 113, 156

[56] References Cited

U.S. PATENT DOCUMENTS

| | | | |
|---|---|---|---|
| 1,882,949 | 10/1932 | Ruder | 55/156 X |
| 2,751,036 | 6/1956 | Busfield | 55/148 X |
| 3,606,733 | 9/1971 | Arstikaitis | 55/148 X |
| 3,729,815 | 5/1973 | Quintilian et al. | 55/145 X |
| 3,892,545 | 7/1975 | Goransson | 55/148 X |

FOREIGN PATENT DOCUMENTS

| | | | |
|---|---|---|---|
| 442645 | 4/1927 | Fed. Rep. of Germany | 55/149 |
| 51-174 | 4/1977 | Japan | 55/148 |

*Primary Examiner*—Kathleen J. Prunner

*Attorney, Agent, or Firm*—William W. Habelt

[57] ABSTRACT

A collecting electrode panel assembly for use in an electrostatic precipitator (10) comprises a plurality of collecting electrode plates (22) disposed in successively aligned relationship beneath and suspended from an electrode support beam (14) supported upon support beam (60) suspended from the upper region of the housing (12) of the electrostatic precipitator. The support beam (60), comprises an elongated flange support beam having a generally J-shaped cross-section having an upright leg (62), a base flange (64) extending transversely outward from the lower end of the upright leg, and a lip flange (68) extending upwardly from the outward edge of the base flange (64). The base flange (64) provides a support surface (66) upon which the end of the electrode support beam (14) rests. Notches (80) are cut in the lip flange (68) of the support beam (14) at appropriate locations to receive at each location the end of an electrode support beam (14). Hanger rods (70) are mounted to the upright leg (62) of the flange support beam (60) for suspending the support beam (60) from the housing of the electrostatic precipitator. The hanger rods (70) are adjustable so as to permit the elevation of the support beam (60) to be adjusted so as to assist in leveling the collecting electrode support beams (14) supported from the flanged support beam (60).

2 Claims, 6 Drawing Figures

COLLECTING ELECTRODE PANEL ASSEMBLY

BACKGROUND OF THE INVENTION

The present invention relates to electrostatic precipitators and, more particularly, to supporting a collecting electrode panel assembly comprising a plurality of individual collecting electrode plates suspended from a support beam which in turn is suspended from the precipitator housing.

In the operation of electrostatic precipitator, a gas laden with entrained particulate matter will pass through an electrostatic field established about a discharge electrode assembly disposed intermediate two grounded collecting electrode panels. The suspended particles become electrically charged as they pass through the electrostatic field and move to, under the influence of the electrostatic field, and deposit upon the grounding collecting electrode panels flanking the discharge electrode assembly.

Although the prior art includes various collecting electrode panel designs, collecting electrode panels are commonly constructed in modular form by suspending a plurality of successively aligned collecting electrode plates in end-to-end relationship to form the collecting electrode panel. Each collecting electrode plate is typically suspended to extend downwardly in a vertical plane from a support beam disposed in the top of the precipitator housing to extend transversely between and sit atop spaced beams. Each individual plate is formed of sheet metal and typically ranges from one to three feet in width and from thirty to fifty feet in length. One common configuration of collecting electrode panel and its support arrangement is shown in U.S. Pat. No. 4,240,810.

In the prior art, the collecting electrode support beam from which the collecting electrode plates are suspended is typically supported by merely sitting the ends of the support beam on girder flanges which extend transversely across the top of the precipitation chamber at the inlet and outlet ends thereof. As the support beams merely sit on the flanges of the girder beams, it is usually necessary to place shims underneath the ends of the support beams and the girder flanges in order to level the collecting electrode support beam during installation. At the same time, it is necessary to adjust the lateral placement of the collecting electrode support beam along the girder flanges to insure proper spacing between the collecting electrode panels suspended from adjacent support beams. Further, when installing prior art collecting electrode assemblies so supported into a precipitator, it is often necessary to rotate and swing the plates in a transverse direction in order to clear structural obstacles and to properly place the support beams on the girder flanges. Naturally, trained labor and appropriate tooling are required to accomplish such installation.

Accordingly, it is an object of the present invention to provide a collecting electrode panel assembly having a support system for supporting the collecting electrode support beam which simplifies installation and alignment of the collecting electrode panel assembly.

SUMMARY OF THE INVENTION

The collecting electrode panel assembly of the present invention comprises a plurality of collecting electrode plates disposed in successively aligned relationship beneath and suspended from an electrode support beam supported upon support means suspended from the upper region of the housing of the electrostatic precipitator such that the collecting electrode plates making up the collecting electrode panel extend downwardly in substantially vertical planes into the precipitator chamber defined within the housing. Support means are disposed adjacent each of the axially opposite ends of the electrode support beams for engaging the end of the electrode support beam adjacent thereto in supporting relationship. The support means are adapted to be suspended from the housing of the electrostatic precipitator by hanger means so that the elevation of the support means may be readily adjusted to assist in leveling the collecting electrode support beam. The support means provides a contact surface, preferably in the form of an outwardly extending flange, upon which the electrode support beam rests in supporting relationship. The electrode support beam has a lower surface having an arcuate protrusion extending outwardly therefrom, preferably in the form of an axially elongated bar having an arcuate outer surface. When the end of the electrode support beam and the support means are placed in engaging relationship, the arcuate protrusion extending outwardly from the lower surface of the electrode support beam will rest upon the contact surface of the support means in supporting relationship.

Preferably, the support means comprises an elongated flange support beam having a generally J-shaped cross-section having an upright leg, a base flange extending transversely outward from the lower end of the upright leg, and a lip flange extending upwardly from the outward edge of the base flange. Openings are cut in the lip flange of the support beam at appropriate locations to receive at each location the end of an electrode support beam. The hanger means are mounted to the upright leg of the flange support beam for suspending the support beam from the housing of the electrostatic precipitator. The hanger means are adjustable so as to permit the elevation of the support beam to be adjusted prior to installation of the collecting electrode panel assemblies so as to ensure proper of leveling the collecting electrode support beams when supported from the flanged support beam.

Further, in order to ensure positive engagement of each of the ends of the collecting electrode support beams with the transversely extending flanged support beams, a transverse slot is preferably cut in the collecting electrode support beams near their ends such that the slot will engage the lip flange of the flanged support beam when the end of the collecting electrode support beam rests upon the base flange of the support beam. Alternatively, a hole may be drilled transversely through the end of the collecting electrode support beam outwardly from the transverse slot to accommodate pin shop installed means which may be inserted therethrough when the collecting electrode support beam is rested upon the base flange of the flanged support beam.

BRIEF DESCRIPTION OF THE DRAWINGS

The present invention will be better understood and appreciated when viewed in light of the following description of a preferred embodiment with reference to the accompanying drawings, wherein.

DESCRIPTION OF THE PREFERRED EMBODIMENT

Figure 1:
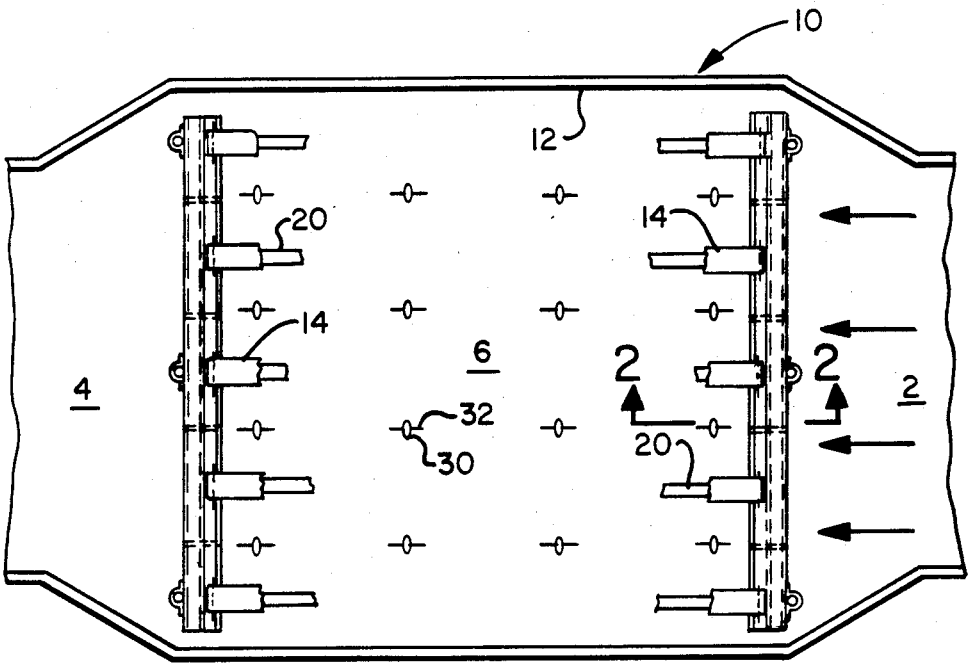
FIG. 1 is a plan view, partly in section, of an electrostatic precipitator incorporating the collecting electrode assembly of the present invention.
Figure 2:
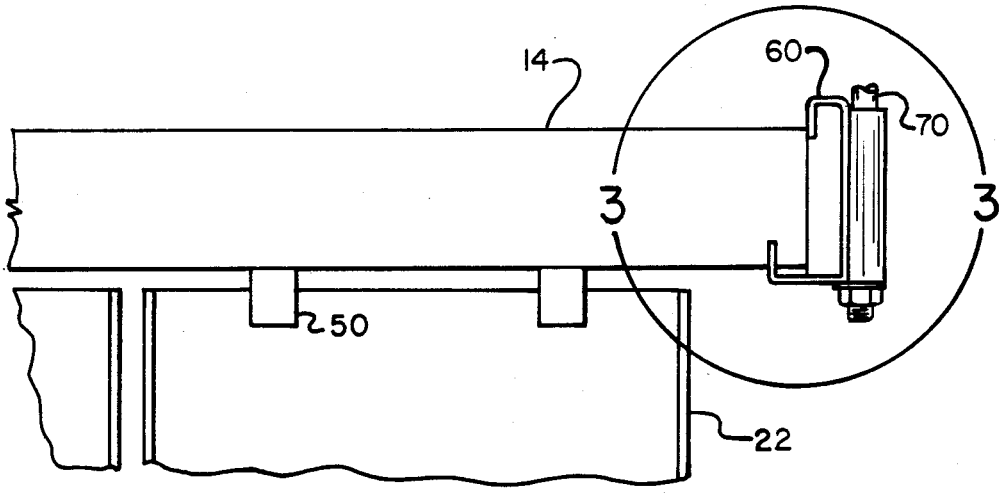
FIG. 2 is a side elevational view taken along line 2—2 of FIG. 1.

Referring now to the drawings, there is depicted therein an electrostatic precipitator 10 having a casing 12 with an inlet 2 and an outlet 4 and a precipitation chamber 6 disposed therebetween. The particulate laden flue gas to be cleaned passes in substantially horizontal flow through the housing 12 of the precipitator 10 from the gas inlet 2 through the precipitation chamber 6 and out the gas outlet 4 as clean, relatively particulate free gas.

A plurality of collecting electrode panels 20 are disposed in substantially parallel, spaced relationship in vertical planes within the precipitation chamber 6. Interdisposed in the spaces between the collecting electrode panels 20 are a plurality of discharge electrodes 30. Both the collecting electrode panels and the discharge electrodes 30 are aligned parallel to and extend in the direction of gas flow through the precipitation chamber 6 from the inlet 2 to the outlet 4 thereof.

The individual discharge electrodes 30 are disposed at spaced intervals in suspension from a support bar, not shown, which extends across the top of the precipitation chamber 6 and is mounted to the casing 12 through insulators, not shown. The individual discharge electrodes 30 are shown as tubular discharge electrodes having a plurality of corona discharge pins 32 extending outwardly from the tubular portion of the discharge electrode. Although the discharge electrodes are shown in the drawing as being of this particular design for purposes of illustration and not limitation, it is to be understood that the present invention contemplates utilizing any of a number of discharge electrode designs known in the art. For example, the discharge electrodes 30 could consist of a plurality of wires or rods, with or without corona discharge points disposed along their length. If the discharge electrodes are of tubular design, the tubular members could have a circular or elliptical cross-section or any other approriate cross-section which would yield the desired electrostatic field configuration.

In operation, a particulate laden gas enters the precipitator casing 12 through the inlet 2 thereof and flows through the precipitation chamber 6 to the outlet 4 thereof. In traversing the precipitation chamber 6, the particulate laden gas flows between the spaced collecting electrode panels 20 and over the discharge electrodes 30 suspended therebetween. An electrical charge is applied to each of the discharge electrodes 30 so as to establish an electrostatic field extending between the discharge electrodes 30 and the grounded collecting electrode panels 20. As the particulates within the gas pass through the precipitation chamber 6, the particulates are ionized and migrate to and deposited upon the collecting electrode plates 22 forming the grounding collecting electrode panels 20.

Each collecting electrode panel 20 is formed of a plurality of collecting electrode plates 22, which are disposed in successively aligned relationship beneath and suspended from an electrode support member or beam 14 which extends across the top of the precipitation chamber 6. The collecting electrode plates 22 are each suspended by one or more suspension means 50 from the collecting electrode support beam 14 extending across the precipitation chamber 6 between support means 60 which is suspended from the top of the precipitation chamber by hanger rods 70.

In the preferred embodiment of the present invention, the support means 60 comprises a flanged support beam having a generally J-shaped cross-section having an upright leg 62, a base flange 64 extending transversely outward from the lower end of the upright leg 62 to provide a contact surface 66 upon which the collecting electrode support beam 14 is supported, and a lip flange 68 extending upwardly from the outward edge of the base flange 64. Although it is conceivable that support means 60 could be a foreshortened bracket supporting only a single collecting electrode support beam 14 without departing from the scope and spirit of the present invention, it is preferred that the support means 60 comprise a continuous elongated flanged beam extending transversely across the upper region of the precipitator housing. Of course, one such beam would extend across the inlet end of the housing 12 to support one axially outward end of the collecting electrode support means 14, while a similar support means 60 would extend across the outlet end of the precipitator housing to support the opposite axially end of each of the collecting electrode support beams 14.

Each flanged support beam 60 is suspended by a plurality of hanger rods 70 from support structure, not shown, in the roof of the precipitator housing. Each hanger rod 70 is adjustably suspended, such as by threaded connection, from the support structure, and passes vertically downwardly through a surrounding hanger tube 72 which is mounted, such as by welding, to the backside of the upright leg 62 of the flanged support beam 60. A lock nut 74 is threaded on to the lower end of the hanger rod 70 to abut the lower end of the hanger rod 70 to hold the flanged support beam 60 at the proper elevation. By adjusting the effective length of the hanger rod, the local elevation of the flanged support beam 60 can be changed to assist in leveling the collecting electrode support beams 14 supported on the flanged support beam 60.

Figure 4:
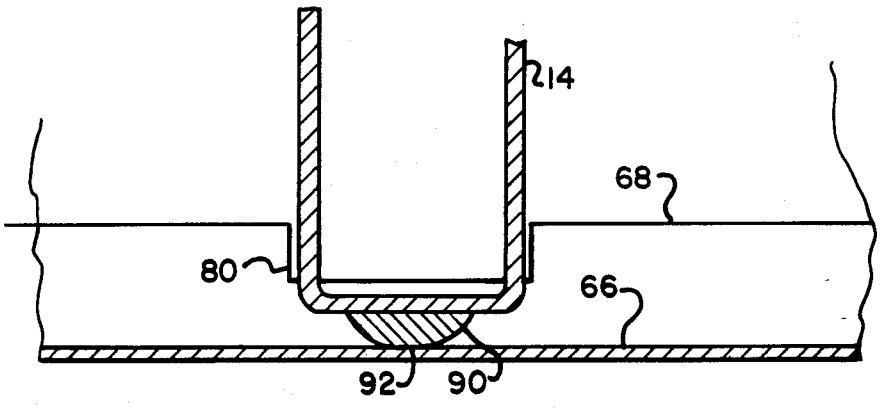
FIG. 4 is a sectional elevational view taken along line 4—4 of FIG. 3.

As best seen in FIGS. 1 and 4, the lip flange 68 of the elongated flanged support beam 60 is notched at appropriate locations along its span to provide notches 80 adapted to receive the axially outward end of the support beam 14 adjacent thereto. Each of the notches 80 cut in the lip flange 68 of the flanged support 60 is precut in the shop when the flanged support beam 60 is produced at the proper locations for the collecting electrode beams 14 so as to ensure an even spacing between adjacent collecting electrode beams 14 supported therefrom upon installation of the assembly within the precipitator housing.

In accordance with the present invention, the lower surface 16 of the collecting electrode support beam 14 is provided at each of its axially outward ends with an arcuate protrusion 90 extending outwardly therefrom. Preferably, the arcuate protrusion 90 comprises an axially elongated rocker bar having an arcuate outer surface 92 and extending outwardly from the lower surface 16 of the end of the collecting electrode support beam 14. When the collecting electrode support beam 14 is inserted into the notched openings 80 in the lip flange 68 of the flanged support beam 60, the arcuate outer surface 92 of the arcuate protrusion 90 rests upon the contact surface 66 of the base flange 64 of the support means 60 so as to provide the contact therebetween for supporting the collecting electrode support beam 14 upon the support means 60. With the arcuate protrusion 90 in the form of an elongated arcuate bar, the arcuate outer surface 92 thereof provides a line of contact for supporting the collecting electrode support beam 14 from the contact surface 66 of the base flange 64 of the flanged support beam 60 such that the collecting electrode support beam 14 will be self-leveling in a transverse direction between the spaced support means 60 supporting the opposite axial end of the collecting electrode support beams 14. Of course, the arcuate protrusion may be in a form other than the preferred rocker bar form shown in the drawing, so long as the arcuate surface provides a point of contact or a line of contact such that the collecting electrode beam 14 will be self-leveling between its support means 60 thereby eliminating the need of providing shims between the lower surface of the collecting electrode support beams 14 and the contact surface of the support means 60.

Figure 3:
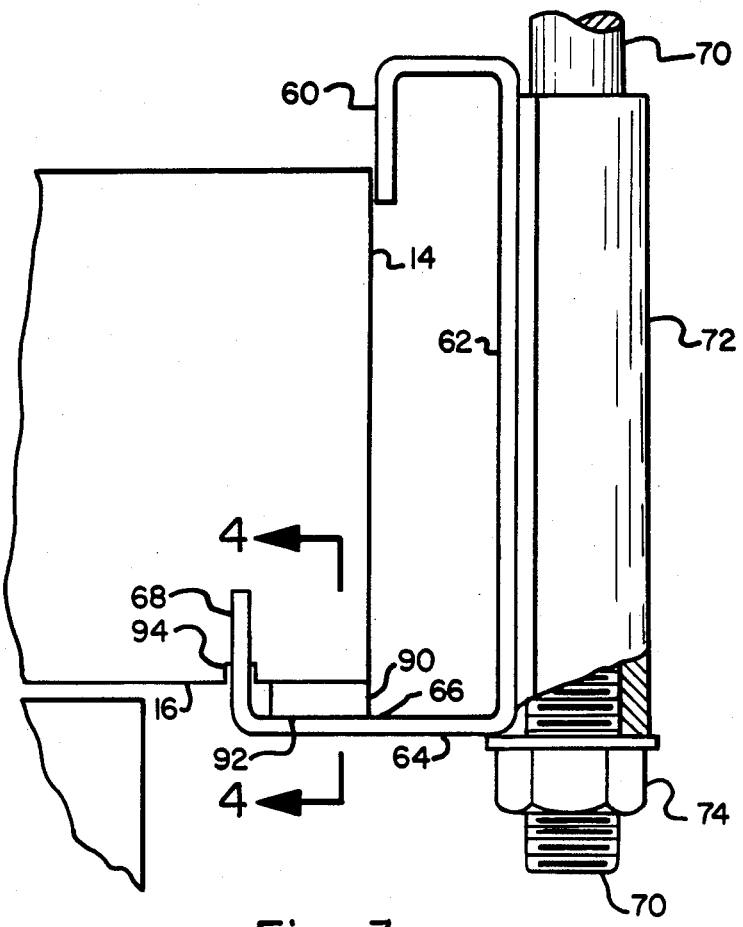
FIG. 3 is an enlarged side elevational view of the section 3—3 of FIG. 2 showing the preferred form of interlocking relationship.

Further, a transverse slot 94 is preferably cut in the base surface 16 and side walls of the collecting electrode beam 14 so that the collecting electrode support beam 14 will positively interlock with the lip 68 of the support means 60 by placing the end of the collecting electrode support beam 14 on the contact surface 66 of the flanged support beam 60 with the end of the collecting electrode support beam 14 inserted within the appropriate notch 80 in the upright lip 68 of the flanged support beam 60 with the transverse slot 94 cut in the lower surface and side walls of the support beam 14 engaging the base portion of the upright lip 68 extending beneath the notch 80 cut in the upright lip 68 for receiving the end of the collecting electrode beam 14. With the transverse slot 94 interlocked with the notch 80 in the upright lip 68 as shown in FIGS. 3 and 4, lateral movement of the collecting electrode support beam 14 is prevented. Additionally, the sides of the collecting electrode support beam 14 are encompassed by the sides of the upright lip 68 flanking the notch 80 thereby preventing transverse movement of the beam 14.

Figure 5:
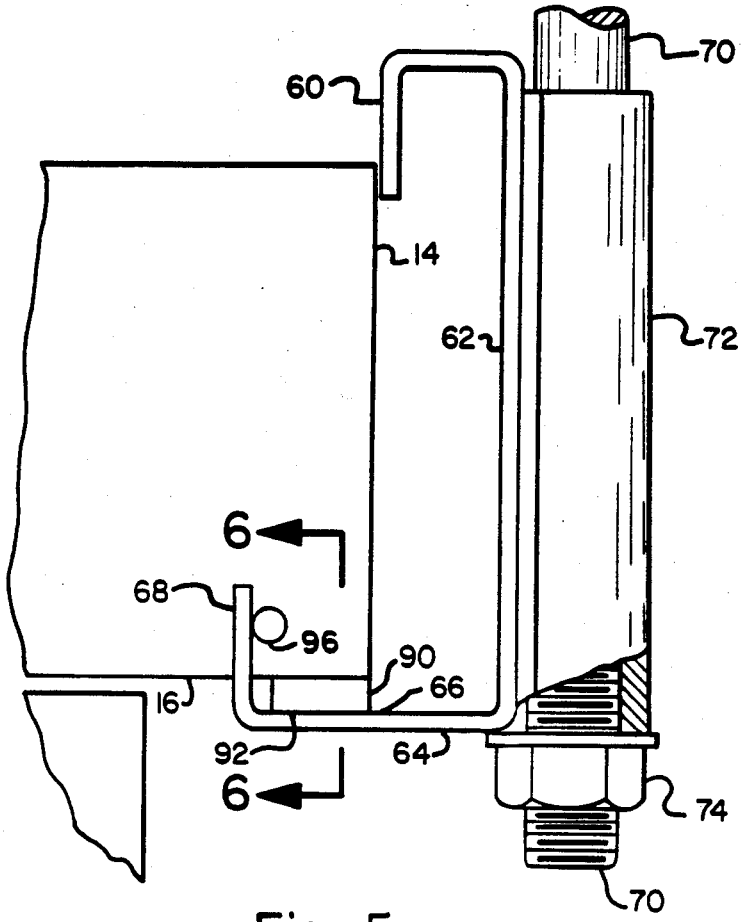
FIG. 5 is an enlarged side elevational view of the section 3—3 of FIG. 2 showing an alternative form of interlocking relationship.
Figure 6:
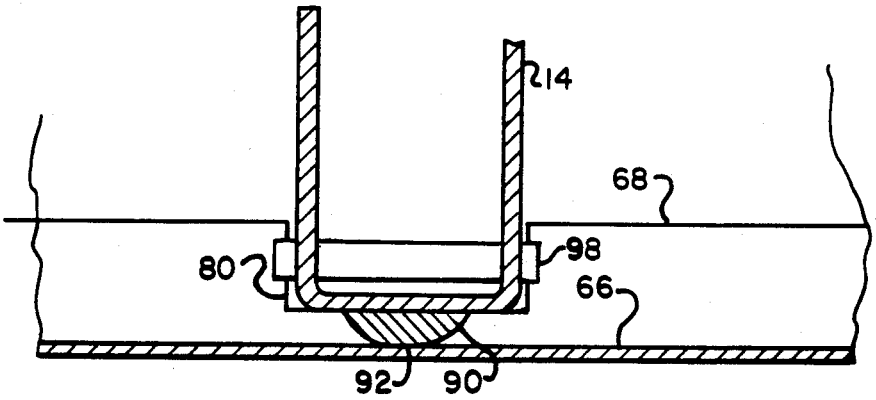
FIG. 6 is a sectional elevational view taken along line 6—6 of FIG. 5.

As an alternate means of ensuring positive engagement during operation, a hole 96 may be drilled through the side walls of the ends of the collecting electrode support beam 14 axially outwardly of the location of the lip 68 to accommodate pin means 98. As shown in FIGS. 5 and 6, pin means 98 is inserted through the transverse hole 96 when the collecting electrode support beam is inserted within the notch 80 cut in the upright lip 68 of the flanged support beam 60 with the arcuate surface 92 of the arcuate protrusion 90 resting upon the contact surface 66 of the base flange 64 of the flanged support beam 60.

To install the collecting electrode assembly of the present invention, a pair of spaced flanged support beams 60 are suspended by hanger means comprising the hanger rod 70, the hanger bracket 72 mounted to the back of the upright leg 62 of the flanged support beam 60, and the lock nut 74, from the girder work in the top of the precipitator housing so as to extend transversely in properly level position across atop the precipitator housing with one of the spaced beams 60 disposed across the inlet end and the other across the outlet end of the precipitator housing. The collecting electrode beam 14, with its collecting electrode plates 22 preassembled and suspended therefrom, may be dropped vertically down through the top of the precipitator housing for direct insertion into the appropriate notches 80 cut in the upright flange 68 of the flanged support beams 60. With the line of contact provided by the arcuate protrusion extending outwardly from the lower surface of the end of the collecting electrode beam 14 and contacting the contact surface 66 of the base flange 64 of the flanged support beams 60, the collecting electrode panels will self-level in a side-to-side direction without any need for shimming between the lower surface of the collecting electrode and the contact surface of the support means 60. With the locking pin 98 inserted into and through the transverse hole 96, each end of the collecting electrode support beam 14 is held in contact with the contact surface 66 at a point externally outward of the upright lip flange 68 of the flanged support beam 60 thereby preventing the collecting electrode beam from sliding axially inward and out of the support means 60 in the event an unexpected movement of the collecting electrode support beam 14 in an axial direction.

We claim:

1. A collecting electrode panel assembly for mounting within a precipitation chamber housing of an electrostatic precipitator, comprising:

a. an axially elongated electrode support beam having axially opposite ends and having a lower surface having an arcuate protrusion extending outwardly from said lower surface at each of the axially opposite ends of said electrode support beam;

b. a plurality of collecting electrode plates disposed in successively aligned relationship beneath and suspended from said electrode support beam; and c. support means disposed adjacent each of the axially opposite ends of said electrode support beam for engaging the end of said electrode support beam adjacent thereto in supporting relationship, said support means adapted to be suspended from the housing of the electrostatic precipitator, said support means comprising a flanged support beam having a generally J-shaped cross-section having an upright leg, a base flange extending transversely outward from the lower end of the upright leg so as to provide a contact surface upon which the arcuate protrusion extending outwardly from said lower surface of said electrode support beam rests in supporting relationship, and a lip flange extending uprightly from the outward edge of the base flange, said lip flange having a notch cut therein adapted to receive an end of said electrode support beam; said arcuate protusion comprising an axially elongated bar having an arcuate outer surface and extending outwardly from said lower surface of the electrode support beam to rest upon the base flange so as to provide a line of contact therebetween for supporting said electrode support beam upon the base flange, each of the axially opposite ends of said electrode support beam having a transverse slot cut therein so as to engage the lip flange of said flanged beam when said electrode support beam rests upon the base flange of said flanged beam support.

2. A collecting electrode panel assembly for mounting within a precipitation chamber housing of an electrostatic precipitator, comprising:

a. an axially elongated electrode support beam having axially opposite ends and having a lower surface having an arcuate protrusion extending outwardly from said lower surface at each of the axially opposite ends of said electrode support beam;

b. a plurality of collecting electrode plates disposed in successively aligned relationship beneath and suspended from said electrode support beam; and c. support means disposed adjacent each of the axially opposite ends of said electrode support beam for engaging the end of said electrode support beam adjacent thereto in supporting relationship, said support means adapted to be suspended from the housing of the electrostatic precipitator, said support means comprising a flanged support beam having a generally J-shaped cross-section having an upright leg, a base flange extending transversely outward from the lower end of the upright leg so as to provide a contact surface upon which the arcuate protrusion extending outwardly from said lower surface of said electrode support beam rests in supporting relationship, and a lip flange extending uprightly from the outward edge of the base flange, said lip flange having a notch out therein adapted to receive an end of said electrode support beam; said arcuate protrusion comprising an axially elongated bar having an arcuate outer surface and extending outwardly from said lower surface of the electrode support beam to rest upon the base flange so as to provide a line of contact therebetween for supporting said electrode support beam upon the base flange, each of the axially opposite ends of said electrode support beam having a hole drilled transversely therethrough at a location disposed outwardly of said lip flange when the electrode support beam is rested upon the base flange; and d. pin means adapted to be inserted through said transverse hole when said electrode support beam is rested upon the base flange.

* * * * *